US011560990B2

(12) United States Patent
Lim et al.

(10) Patent No.: US 11,560,990 B2
(45) Date of Patent: Jan. 24, 2023

(54) LIGHTING APPARATUS WITH LINEAR LIGHT SOURCE

(71) Applicants: HYUNDAI MOTOR COMPANY, Seoul (KR); KIA CORPORATION, Seoul (KR)

(72) Inventors: Jung Wook Lim, Seoul (KR); Byoung Suk Ahn, Gwacheon-si (KR); Seung Sik Han, Hwaseong-si (KR); Sung Ho Park, Seoul (KR); Ki Hong Lee, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/307,788

(22) Filed: May 4, 2021

(65) Prior Publication Data

US 2022/0112992 A1 Apr. 14, 2022

(30) Foreign Application Priority Data

Oct. 13, 2020 (KR) ..... 10-2020-0132077

(51) Int. Cl.

| | |
|---|---|
| ***F21S 4/28*** | (2016.01) |
| ***F21V 21/002*** | (2006.01) |
| ***F21V 29/70*** | (2015.01) |
| ***F21V 21/08*** | (2006.01) |
| ***F21V 23/02*** | (2006.01) |

(52) U.S. Cl.

CPC ..... *F21S 4/28* (2016.01); *F21V 21/002* (2013.01); *F21V 21/08* (2013.01); *F21V 23/02* (2013.01); *F21V 29/70* (2015.01)

(58) Field of Classification Search

CPC ..... F21S 4/28; F21V 29/70; F21V 21/002; F21V 21/08; F21V 23/02

See application file for complete search history.

(56) References Cited

U.S. PATENT DOCUMENTS

2002/0048174 A1* 4/2002 Pederson ..... B60Q 1/2611 362/487

FOREIGN PATENT DOCUMENTS

DE 202012002196 U1 * 4/2012 ..... F21V 31/005
KR 10-2013-0048540 5/2013

* cited by examiner

*Primary Examiner* — Anabel Ton
(74) *Attorney, Agent, or Firm* — Fox Rothschild LLP

(57) ABSTRACT

A lighting apparatus with a linear light source is provided. The lighting apparatus includes a light source extending in a longitudinal direction and having terminal parts on both ends of the light source to be connected to a power supply; a spacer having an internal space that is opened in a front-rear direction and accommodates the light source, wherein mounting parts formed on both ends of the internal space to provide the terminal parts; and a reflective bracket mounted on a rear end of the spacer to cover the internal space, and having fixing parts that match the mounting parts to fix the terminal parts when the reflective bracket is mounted on the spacer, wherein an inner surface of the reflective bracket is configured to reflect light emitted from the light source.

13 Claims, 9 Drawing Sheets

LIGHTING APPARATUS WITH LINEAR LIGHT SOURCE

CROSS-REFERENCE TO RELATED APPLICATION

The present application claims priority to and the benefit of Korean Patent Application No. 10-2020-0132077, filed Oct. 13, 2020, the entire contents of which are incorporated herein for all purposes by this reference.

TECHNICAL FIELD

The present disclosure relates to a lighting apparatus with a linear light source.

BACKGROUND

Generally, a vehicle is provided with a lighting apparatus for making it easy to see objects in a driving direction when driving at night and for informing other vehicles or other road users of the driving state of a host vehicle. A lamp called a headlight is a light that functions to illuminate a vehicle driving course in front of the vehicle.

Such a lamp is classified into a headlamp, a fog light, a turn indicator, a brake light, and a reversing light, which are set to have different light emitting directions onto a road surface. Low beams are emitted through the headlamp in a general driving situation, while high beams are emitted in a special situation.

Meanwhile, an optical system applied to a future vehicle tends to be reduced in overall size, but it is difficult to reduce the size of the optical system under conditions where both the low beams and the high beams may be made. Thus, even if a filament type LED is applied to a vehicle to implement a linear light source, it may be difficult to fix the filament type LED and this is vulnerable to vibration. Therefore, it may be challenging to secure the precise light distribution pattern and light distribution amount of the filament type LED through a conventional fixing method.

The foregoing is intended merely to aid in the understanding of the background of the present disclosure, and is not intended to mean that the present disclosure falls within the purview of the related art that is already known to those skilled in the art.

SUMMARY

The present disclosure provides a lighting apparatus with a linear light source, in which the installation position of the light source is firmly fixed, heating performance is secured, and the amount of light from the light source is secured.

In order to achieve the objective of the present disclosure, the present disclosure provides a lighting apparatus with a linear light source, including a light source extending in a longitudinal direction and having on both ends thereof terminal parts to be connected to a power supply; a spacer having an internal space that is opened in a front-rear direction and accommodates the light source therein, with mounting parts being formed on both ends of the internal space so that the terminal parts are seated thereon; and a reflective bracket mounted on a rear end of the spacer to cover the internal space, and having fixing parts that match the mounting parts to fix the terminal parts when the reflective bracket is mounted on the spacer, with an inner surface of the reflective bracket being made to reflect light emitted from the light source.

The mounting part may be disposed in a rear of the internal space, and have on a rear end thereof a seating groove that is recessed in the same shape as each of the terminal parts of the light source so that the terminal part is seated therein.

A support protrusion may be formed on the rear end of the mounting part to be spaced apart from the seating groove and protrude rearwards.

The support protrusion may be formed at a position spaced apart from the seating groove to extend along a periphery of the seating groove.

The support protrusion may protrude to have a length equal to or longer than a protruding height of the terminal part, in a state where the terminal part is seated in the seating groove.

The fixing part of the reflective bracket may be formed such that a front end thereof coming into contact with the mounting part forms a plane.

The reflective bracket may be divided into a first reflective bracket and a second reflective bracket to be disposed on both sides of the spacer, respectively, a first fixing part may be formed on the first reflective bracket to match a first mounting part of the spacer and come into contact with a first terminal part of the light source, and a second fixing part may be formed on the second reflective bracket to match a second mounting part of the spacer and come into contact with a second terminal part of the light source.

Each of the first reflective bracket and the second reflective bracket may be made of a material allowing heat conduction and electrical conduction.

The first reflective bracket and the second reflective bracket may be fixed to the spacer via a fastening part, and the fastening part may be made to enable electrical conduction, and power from an external device may be applied thereto.

A heat dissipation part may be formed on a rear end of each of the first reflective bracket and the second reflective bracket to dissipate heat generated by the light source to an outside.

The lighting apparatus may further include an installation part formed on a center of the rear end of the spacer to partition the first reflective bracket and the second reflective bracket from each other; and a cover mounted on the installation part behind the spacer via the first reflective bracket, the second reflective bracket, and the fastening part, thus fixing the first reflective bracket and the second reflective bracket to the spacer.

The lighting apparatus may further include a housing formed to be opened in the front-rear direction, accommodating the spacer and the reflective bracket therein, and having on a front end thereof an outer lens, wherein the cover may be mounted on a rear end of the housing so that the spacer and the reflective bracket secured to the cover are fixed to an interior of the housing.

As described above, a lighting apparatus with a linear light source is configured such that the position of a terminal part of the light source is firmly fixed through a spacer to stably supply power. In addition, light emitted from the light source is emitted to the front by a reflective bracket installed in the spacer, and heat generated by the light source is dissipated to the outside through the reflective bracket, so that cooling performance is secured.

DRAWINGS

DETAILED DESCRIPTION

Hereinafter, a lighting apparatus with a linear light source in some forms of the present disclosure will be described with reference to the accompanying drawings.

Figure 1:
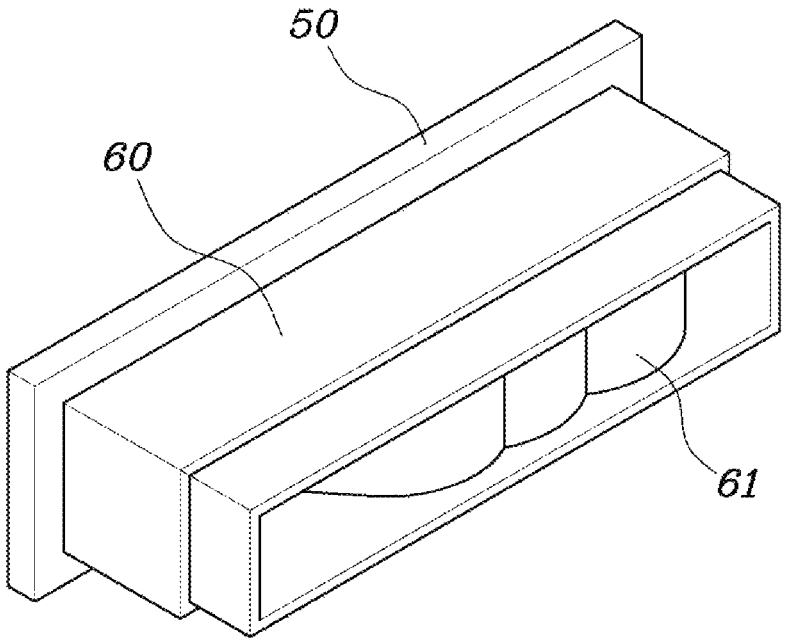
FIG. 1 is a diagram illustrating a lighting apparatus with a linear light source in one form of the present disclosure.
Figure 2:
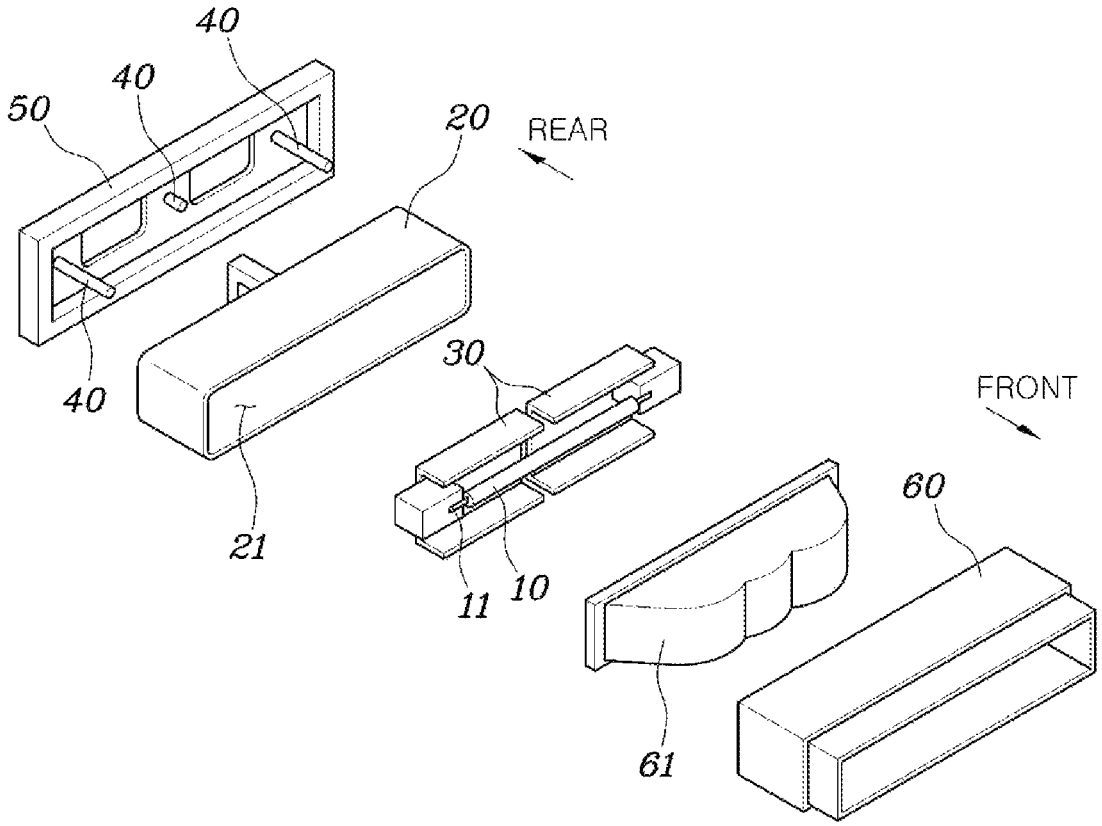
FIG. 2 is a diagram illustrating the assembly of the lighting apparatus with the linear light source shown in FIG. 1.
Figure 3:
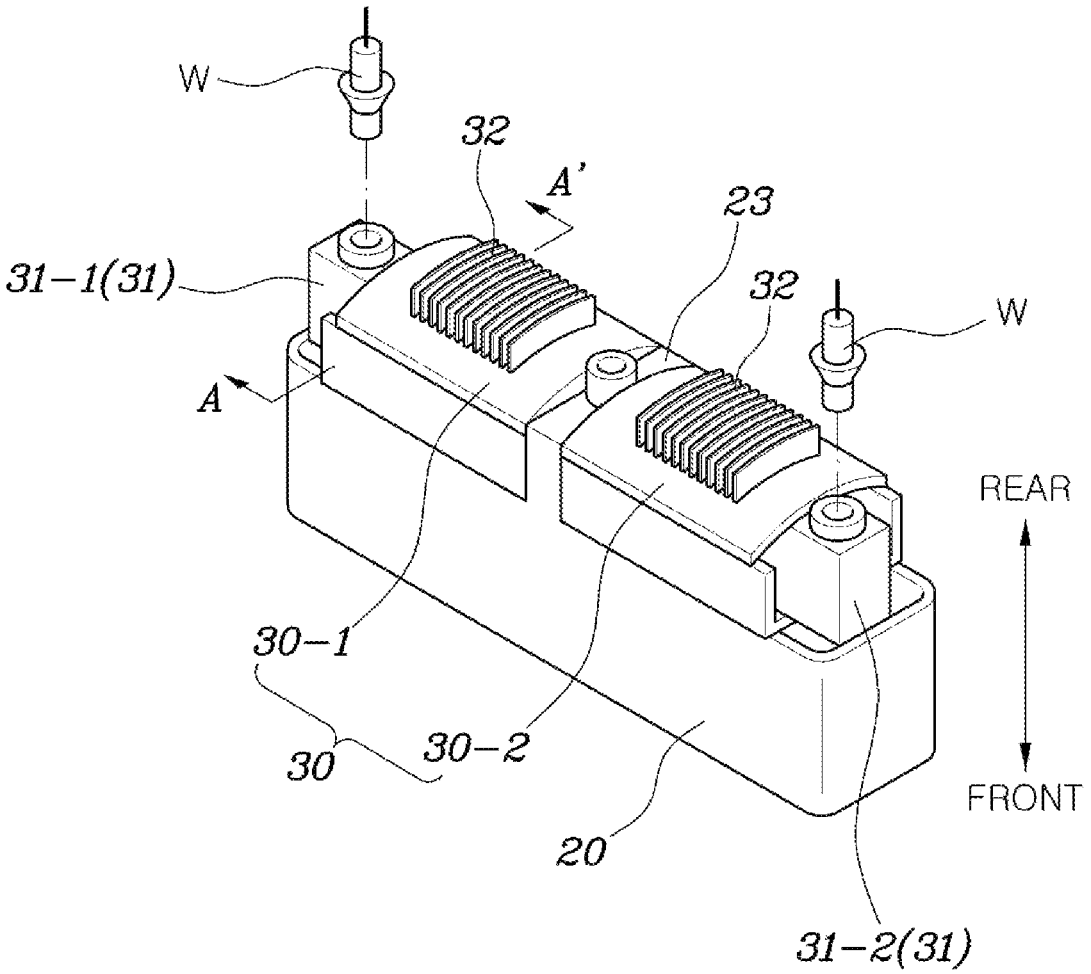
FIG. 3 is a diagram illustrating an embodiment in which a wire is applied to the lighting apparatus with the linear light source shown in FIG. 1.
Figure 4:
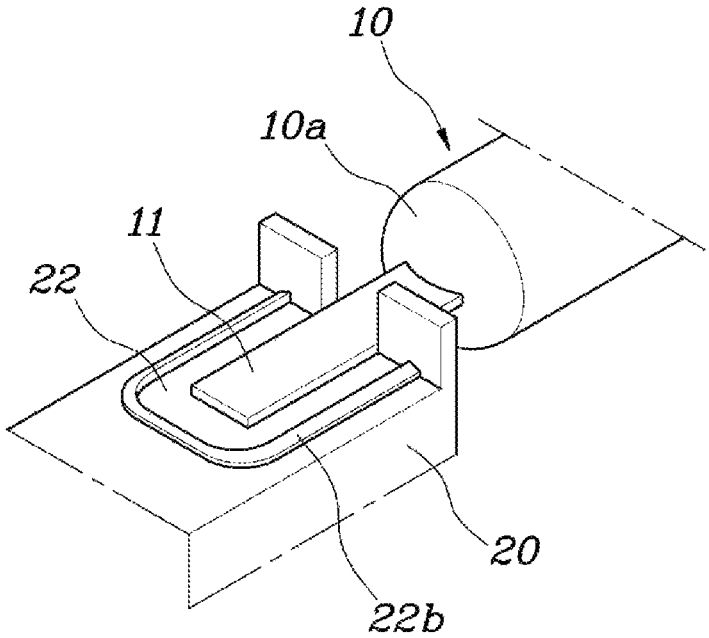
FIG. 4 is a diagram illustrating a mounting part of the lighting apparatus with the linear light source shown in FIG. 1.
Figure 5:
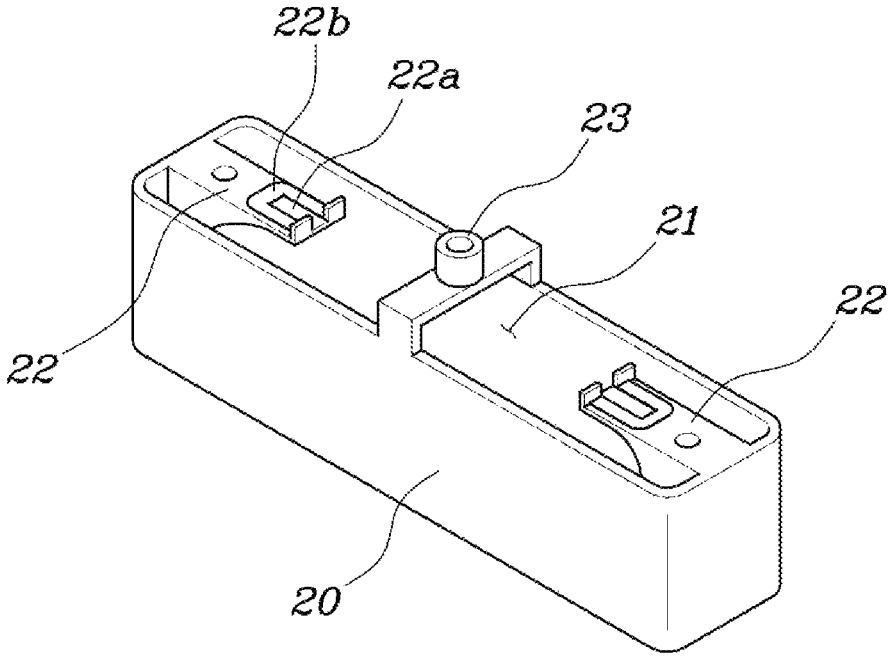
FIG. 5 is a diagram illustrating a spacer of the lighting apparatus with the linear light source shown in FIG. 1.
Figure 6:
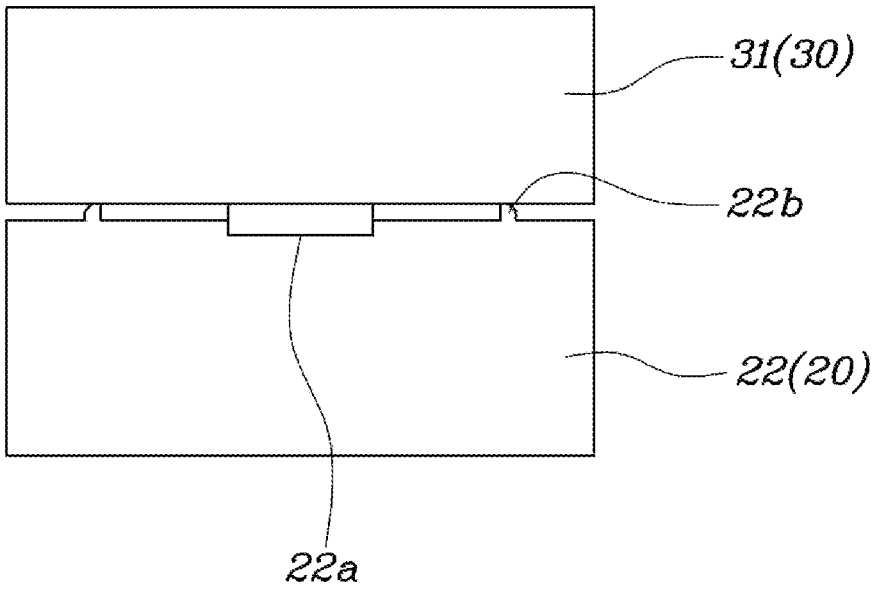
FIG. 6 is a sectional view taken along line A-A' of FIG. 3.
Figure 7:
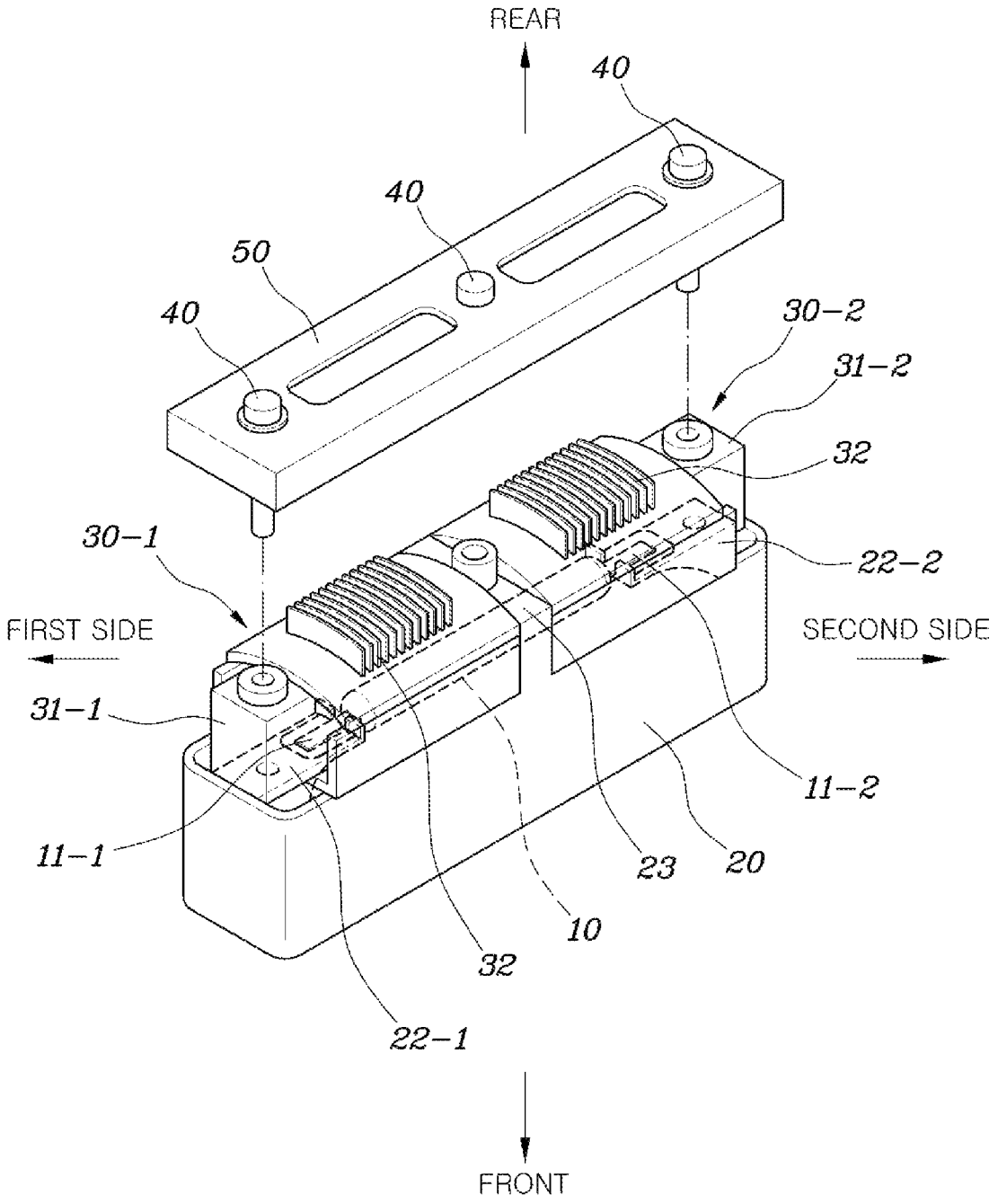
FIG. 7 is a diagram illustrating an embodiment in which a fastening part is applied to the lighting apparatus with the linear light source shown in FIG. 1.
Figure 8:
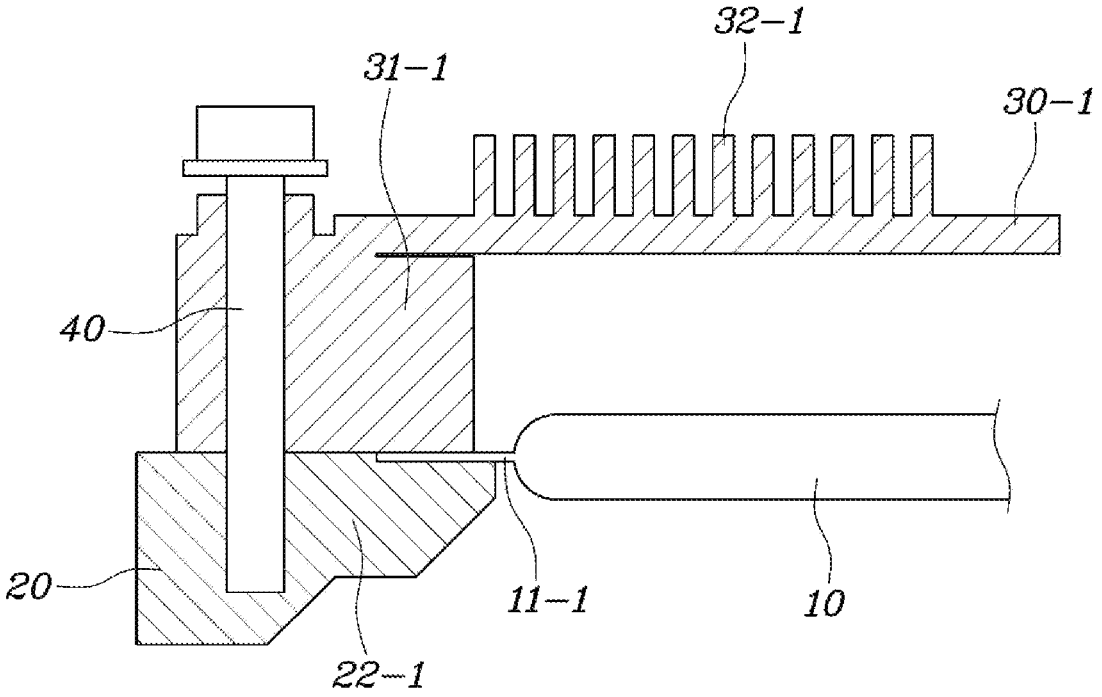
FIG. 8 is a sectional view of the lighting apparatus with the linear light source shown in FIG. 7.
Figure 9:
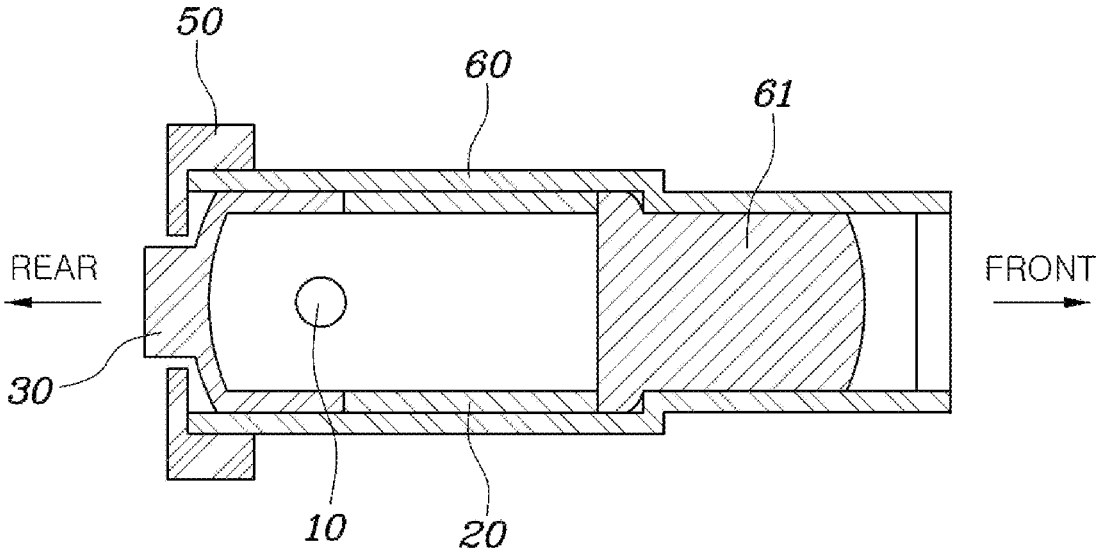
FIG. 9 is a sectional view illustrating the lighting apparatus with the linear light source in one form of the present disclosure.

FIG. 1 is a diagram illustrating a lighting apparatus with a linear light source in some forms of the present disclosure, FIG. 2 is a diagram illustrating the assembly of the lighting apparatus with the linear light source shown in FIG. 1, FIG. 3 is a diagram illustrating an embodiment in which a wire is applied to the lighting apparatus with the linear light source shown in FIG. 1, FIG. 4 is a diagram illustrating a mounting part of the lighting apparatus with the linear light source shown in FIG. 1, FIG. 5 is a diagram illustrating a spacer of the lighting apparatus with the linear light source shown in FIG. 1, FIG. 6 is a sectional view taken along line A-A' of FIG. 3, FIG. 7 is a diagram illustrating an embodiment in which a fastening part is applied to the lighting apparatus with the linear light source shown in FIG. 1, FIG. 8 is a sectional view of the lighting apparatus with the linear light source shown in FIG. 7, and FIG. 9 is a sectional view illustrating the lighting apparatus with the linear light source in some forms of the present disclosure.

As shown in FIGS. 1 to 3, the lighting apparatus with the linear light source in some forms of the present disclosure includes a light source 10 that extends in a longitudinal direction and has on both ends thereof terminal parts 11 to be connected to a power supply; a spacer 20 having an internal space 21 that is opened in a front-rear direction and accommodates the light source 10 therein, with mounting parts 22 being formed on both ends of the internal space 21 so that the terminal parts 11 are seated thereon; and a reflective bracket 30 that is mounted on a rear end of the spacer 20 to cover the internal space 21, and has fixing parts 31 matching the mounting parts 22 to fix the terminal parts 11 when the reflective bracket is mounted on the spacer 20, with an inner surface of the reflective bracket being made to reflect light emitted from the light source 10.

Here, the light source 10 may include a light emitting part 10*a* that is formed of a filament type LED to emit light, and the terminal parts 11 that are provided on both ends of the light emitting part 10*a* to be connected to the power supply. Such a light source 10 is provided in the internal space 21 of the spacer 20, and the mounting parts 22 are formed on both ends of the internal space 21 of the spacer 20, so that each terminal part 11 of the light source 10 is seated in the corresponding mounting part 22 to be fixed in position. The spacer 20 is formed of a non-conductor so that it is not electrically connected to the terminal part 11.

Here, the reflective bracket 30 is mounted on the rear end of the spacer 20. The reflective bracket 30 is mounted on the rear end of the spacer 20 to cover the internal space 21, so that light emitted from the light source 10 is emitted to the front of the spacer 20 through the front end of the spacer 20 that is opened. Furthermore, the inner surface of the reflective bracket 30 is made to reflect light emitted from the light source 10, thus allowing light emitted from the light source 10 to be moved to the front end of the spacer 20. Thus, reflective coating may be applied to the inner surface of the reflective bracket 30.

In addition, the reflective bracket 30 has the fixing parts 31 matching the mounting parts 22 when the reflective bracket is mounted on the spacer 20. Thus, when the reflective bracket 30 is mounted on the spacer 20, the mounting parts 22 match the fixing parts 31 to surround and fix the terminal parts 11, so that the positions of the terminal parts 11 are fixed.

In some forms of the present disclosure, as the terminal part 11 of the light source 10 formed of the filament LED is firmly fixed to the spacer 20 via the reflective bracket 30, the quality of the lighting apparatus is improved. Further, due to the characteristics of the filament LED, the emitted light is guided to be emitted only to the front of the spacer 20 by the reflective bracket 30, thus improving light efficiency.

The present disclosure will be described below in detail.

As shown in FIGS. 4 to 6, the mounting part 22 of the spacer 20 is disposed in the rear of the internal space 21, and has on a rear end thereof a seating groove 22*a* that is recessed in the same shape as the terminal part 11 of the light source 10 so that the terminal part 11 is seated therein. As the mounting part 22 is disposed in the rear of the internal space 21, it is advantageous to match the mounting part 22 with the fixing part 31 of the reflective bracket 30 mounted on the rear end of the spacer 20. Furthermore, as the light source 10 fixed through the mounting part 22 is located in the rear of the internal space 21 of the spacer 20, the light of the light source 10 may be reflected from the internal space 21 to be emitted to the front.

The seating groove 22*a* in which the terminal part 11 is seated is formed in the mounting part 22. The seating groove 22*a* is formed to have the same shape as the terminal part 11, thus restricting the position of the terminal part 11 seated in the seating groove 22*a* so as to prevent the terminal part from being moved laterally or vertically.

Meanwhile, a support protrusion 22*b* is formed on the rear end of the mounting part 22 to be spaced apart from the seating groove 22*a* and protrude rearwards.

Such a support protrusion 22*b* functions to absorb pressure generated when the fixing part 31 moves towards the mounting part 22 and excessively presses the terminal part 11, in the case of mounting the reflective bracket 30 on the spacer 20. In other words, when the reflective bracket 30 is mounted on the spacer 20, the fixing part 31 moves towards the mounting part 22 and comes into contact with the support protrusion 22*b* along with the terminal part 11 seated in the seating groove 22*a*, so that the position of the terminal part 11 in the seating groove 22*a* is restricted laterally and vertically, and the position of the terminal part is restricted in the front-rear direction between the mounting part 22 and the fixing part 31. Thus, the position of the light source 10 is fixed in the spacer 20 and the reflective bracket 30, and the light source is fixedly pressed to an optimum level of pressure by the support protrusion 22*b*. Therefore, even if vibration occurs, the position of the terminal part 11 may be maintained.

Such a support protrusion 22*b* may be formed at a position spaced apart from the seating groove 22*a* to extend along the periphery of the seating groove 22*a*. The support protrusion 22*b* may comprise a plurality of protrusions along the periphery of the seating groove 22*a*. However, since the protruding lengths of the protrusions may be different from each other, the protrusion is preferably formed to extend along the periphery of the seating groove 22*a*. In addition, when the support protrusion 22*b* has an elongated shape, the support protrusion may come into contact with the fixing part 31 of the reflective bracket 30 in balance without being biased to one side.

Furthermore, the support protrusion 22*b* may protrude to have a length equal to or longer than the protruding height of the terminal part 11, in a state where the terminal part 11 is seated in the seating groove 22*a*. Thus, as the reflective bracket 30 is mounted on the spacer 20, the support protrusion 22*b* protruding from the mounting part 22 may support the fixing part 31 when the mounting part 22 matches the fixing part 31, thus preventing the terminal part 11 from being excessively pressed. When the protruding height of the support protrusion 22*b* is lower than the protruding height of the terminal part 11, the support protrusion 22*b* does not come into contact with the fixing part 31, and the terminal part 11 may be excessively pressed by the fixing part 31. Therefore, the support protrusion 22*b* protrudes to the same length as the protruding height of the terminal part 11, or protrudes farther than the protruding height of the terminal part 11.

Furthermore, the fixing part 31 of the reflective bracket 30 is formed such that a front end thereof coming into contact with the mounting part 22 forms a plane, thus allowing pressing force to be uniformly distributed without being biased to one side when the fixing part 31 comes into contact with the support protrusion 22*b*. Thus, since the support protrusion 22*b* also protrudes from the periphery of the seating groove 22*a* to the same height, the pressing force generated by the matching of the fixing part 31 with the mounting part 22 may be uniformly distributed, and thereby uniform force may be applied to the section of the terminal part 11.

In the above-described lighting apparatus with the linear light source 10, wires W pass through both ends of the reflective bracket 30 to be connected to the terminal parts 11 of the light source 10, so that the light source 10 may be supplied with power and then emit light.

Meanwhile, as shown in FIGS. 7 to 9, the reflective bracket 30 is divided into a first reflective bracket 30-1 and a second reflective bracket 30-2 to be disposed on both sides of the spacer 20, respectively. A first fixing part 31-1 may be formed on the first reflective bracket 30-1 to match a first mounting part 22-1 of the spacer 20 and come into contact with a first terminal part 11-1 of the light source 10, and a second fixing part 31-2 may be formed on the second reflective bracket 30-2 to match a second mounting part 22-2 of the spacer 20 and come into contact with a second terminal part 11-2 of the light source 10.

The first reflective bracket 30-1 and the second reflective bracket 30-2 may be identically formed, and be mounted on the spacer 20 without distinction between the first side and the second side. The first reflective bracket 30-1 is mounted on the first side of the spacer 20, and the first fixing part 31-1 matches the first mounting part 22-1 of the spacer 20 to fix the first terminal part 11-1 of the light source 10. The second reflective bracket 30-2 is mounted on the second side of the spacer 20, and the second fixing part 31-2 matches the second mounting part 22-2 of the spacer 20 to fix the second terminal part 11-2 of the light source 10. Thereby, the light source 10 may be fixed to the spacer 20 through the first reflective bracket 30-1 and the second reflective bracket 30-2.

The seating groove 22*a* having the same shape as the terminal part 11 of the light source 10 is formed on each mounting part 22, so that the terminal part 11 seated in the seating groove 22*a* may be restricted in position, thus preventing the terminal part from being moved laterally and vertically. Furthermore, the support protrusion 22*b* is formed around each mounting part 22 to absorb pressure generated when each fixing part 31 moves towards the mounting part 22 and thereby excessively presses the terminal part 11.

Particularly, the first reflective bracket 30-1 and the second reflective bracket 30-2 may be made of a material allowing heat conduction and electrical conduction. In other words, each of the first reflective bracket 30-1 and the second reflective bracket 30-2 may be made of a metal material, be metal-plated, or be made of a conductive polymer composite. Thus, when power is applied to the reflective bracket 30 in a state where the first reflective bracket 30-1 and the second reflective bracket 30-2 are mounted on the spacer 20 to come into contact with the first terminal part 11-1 and the second terminal part 11-2 of the light source 10, respectively, power may be supplied to the light source 10.

In detail, the first reflective bracket 30-1 and the second reflective bracket 30-2 may be fixed to the spacer 20 via a fastening part 40, and the fastening part 40 may be made to enable electrical conduction, and power from an external device may be applied thereto. Here, the fastening part 40 may comprise a bolt, and pass through each of the first fixing part 31-1 of the first reflective bracket 30-1 and the second fixing part 31-2 of the second reflective bracket 30-2 to be fastened to the spacer 20. Thereby, the first reflective bracket 30-1 and the second reflective bracket 30-2 may be fastened to the spacer 20 by bolting. Particularly, the fastening part 40 is made to enable electrical conduction and receives power from the external device. In other words, when the light source 10 is applied to the vehicle, the fastening part 40 receives power from a battery for the vehicle, and all of the fastening part 40, the first reflective bracket 30-1, and the second reflective bracket 30-2 are made to enable electrical conduction. Thus, the first terminal part 11-1 of the light source 10 receives power passing through the fastening part 40 and the first reflective bracket 30-1, and the second terminal part 11-2 receives power passing through the fastening part 40 and the second reflective bracket 30-2. Thus, if power of a different polarity is applied to each fastening part 40, the power is transmitted to the first reflective bracket 30-1 and the second reflective bracket 30-2, the first fixing part 31-1 of the first reflective bracket 30-1 comes into contact with the first terminal part 11-1 of the light source 10, and the second fixing part 31-2 of the second reflective bracket 30-2 comes into contact with the second terminal part 11-1 of the light source 10, so that the light source 10 is supplied with power for emitting light.

Here, as the first reflective bracket 30-1 and the second reflective bracket 30-2 are separated and spaced apart from each other, a problem due to short circuit does not occur even if powers of different polarities are applied.

Meanwhile, as shown in FIGS. 7 and 8, a heat dissipation part 32 may be formed on the rear end of each of the first reflective bracket 30-1 and the second reflective bracket 30-2 to dissipate heat generated by the light source 10 to the outside. Thus, when radiant heat generated as the light source 10 emits light is transferred to the first reflective bracket 30-1 and the second reflective bracket 30-2, each of the first reflective bracket 30-1 and the second reflective bracket 30-2 may emit heat to the outside through the heat dissipation part 32 thereof. Furthermore, as each of the first reflective bracket 30-1 and the second reflective bracket 30-2 is connected to the terminal part 11 of the light source 10, conductive heat transferred through the terminal part 11 is also dissipated through the heat dissipation part 32 to the outside. Here, the heat dissipation part 32 may be composed of a plurality of heat dissipation fins, thus preventing deterioration in durability due to the overheating of the light source 10 as the heat dissipation part 32 dissipates heat.

Meanwhile, an installation part 23 is formed on the center of the rear end of the spacer 20 to partition the first reflective bracket 30-1 and the second reflective bracket 30-2 from each other. A cover 50 is mounted on the installation part 23 behind the spacer 20 via the first reflective bracket 30-1, the second reflective bracket 30-2, and the fastening part 40, thus fixing the first reflective bracket 30-1 and the second reflective bracket 30-2 to the spacer 20.

As the installation part 23 is formed on the center of the rear end of the spacer 20, the first reflective bracket 30-1 is mounted on the first side of the installation part 23, and the second reflective bracket 30-2 is mounted on the second side of the installation part 23, so that the first reflective bracket 30-1 and the second reflective bracket 30-2 are spaced apart from each other.

Furthermore, since the cover 50 is mounted on the installation part 23 via the fastening part 40 to cover the first reflective bracket 30-1 and the second reflective bracket 30-2, the cover prevents the first reflective bracket 30-1 and the second reflective bracket 30-2 from being removed from the spacer 20. In addition, the fastening part 40 passing through the first reflective bracket 30-1 to be fastened to the first side of the spacer 20 and the fastening part 40 passing through the second reflective bracket 30-2 to be fastened to the second side of the spacer 20 are also configured to pass through both ends of the cover 50, so that the cover 50, the reflective bracket 30, and the spacer 20 may be integrally coupled with each other.

Meanwhile, as shown in FIGS. 2 and 9, the lighting apparatus further includes a housing 60 that is formed to be opened in the front-rear direction, accommodates the spacer 20 and the reflective bracket 30 therein, and has on a front end thereof an outer lens 61. Here, the cover 50 is mounted on the rear end of the housing 60 so that the spacer 20 and the reflective bracket 30 secured to the cover 50 are fixed to the interior of the housing 60. Thereby, the light source 10, the spacer 20, and the reflective bracket 30 are protected by the housing 60 and the cover 50, in addition to preventing impurities from entering the lighting apparatus.

As described above, the lighting apparatus with the linear light source 10 is configured such that the position of the terminal part of the light source 10 is firmly fixed through the spacer 20 to stably supply power. In addition, light emitted from the light source 10 is emitted to the front by the reflective bracket installed in the spacer 20, and heat generated by the light source 10 is dissipated to the outside through the reflective bracket, so that cooling performance is secured.

Although the present disclosure was described with reference to specific embodiments shown in the drawings, it is apparent to those skilled in the art that the present disclosure may be changed and modified in various ways without departing from the scope of the present disclosure, which is described in the following claims.

What is claimed is:

1. A lighting apparatus with a linear light source, comprising:
- a light source extending in a longitudinal direction and having terminal parts on both ends of the light source to be connected to a power supply;
- a spacer having an internal space that is opened in a front-rear direction and accommodates the light source, wherein mounting parts formed on both ends of the internal space to provide the terminal parts; and
- a reflective bracket mounted on a rear end of the spacer to cover the internal space, and having fixing parts that match the mounting parts to fix the terminal parts when the reflective bracket is mounted on the spacer, wherein an inner surface of the reflective bracket is configured to reflect light emitted from the light source,
- wherein the mounting part is disposed in a rear of the internal space, and has, on a rear end of the mounting part, a seating groove that is recessed in the same shape as each of the terminal parts of the light source to provide the terminal part, wherein a position of the terminal part seated in the seating groove is restricted.

2. The lighting apparatus of claim 1, wherein a support protrusion is formed on the rear end of the mounting part to be spaced apart from the seating groove and protrude rearwards.

3. The lighting apparatus of claim 2, wherein the support protrusion is formed at a position spaced apart from the seating groove to extend along a periphery of the seating groove.

4. The lighting apparatus of claim 2, wherein the support protrusion has a length equal to or greater than a protruding height of the terminal part when the terminal part is provided in the seating groove.

5. The lighting apparatus of claim 1, wherein the fixing part of the reflective bracket is formed such that a front end of the fixing part contacting with the mounting part forms a plane.

6. The lighting apparatus of claim 1, wherein:
- the reflective bracket is divided into a first reflective bracket and a second reflective bracket to be disposed on both sides of the spacer, respectively,
- a first fixing part is formed on the first reflective bracket to match a first mounting part of the spacer and contact a first terminal part of the light source, and
- a second fixing part is formed on the second reflective bracket to match a second mounting part of the spacer and contact a second terminal part of the light source.

7. The lighting apparatus of claim 6, wherein each of the first reflective bracket and the second reflective bracket is a material allowing heat conduction and electrical conduction.

8. The lighting apparatus of claim 7, wherein:
- the first reflective bracket and the second reflective bracket are fixed to the spacer
- via a fastening part, the fastening part enables the electrical conduction, and power from an external device is applied to the fastening part.

9. The lighting apparatus of claim 7, wherein a heat dissipation part is formed on a rear end of each of the first reflective bracket and the second reflective bracket to dissipate heat generated by the light source to an outside.

10. The lighting apparatus of claim 6, further comprising:
- an installation part formed on a center of the rear end of the spacer to partition the first reflective bracket and the second reflective bracket; and a cover mounted on the installation part behind the spacer via the first reflective bracket, the second reflective bracket, and the fastening part to fix the first reflective bracket and the second reflective bracket to the spacer.

11. The lighting apparatus of claim 10, further comprising: a housing opened in a front-rear direction, the housing accommodating the spacer and the reflective bracket, and having on a front end of an outer lens, wherein the cover is mounted on a rear end of the housing to fix the spacer and the reflective bracket secured to the cover to an interior of the housing.

12. A lighting apparatus with a linear light source, comprising:

a light source extending in a longitudinal direction and having terminal parts on both ends of the light source to be connected to a power supply;

a spacer having an internal space that is opened in a front-rear direction and accommodates the light source, wherein mounting parts formed on both ends of the internal space to provide the terminal parts; and a reflective bracket mounted on a rear end of the spacer to cover the internal space, and having fixing parts that match the mounting parts to fix the terminal parts when the reflective bracket is mounted on the spacer, wherein an inner surface of the reflective bracket is configured to reflect light emitted from the light source, wherein the fixing part of the reflective bracket is formed such that a front end of the fixing part contacting with the mounting part forms a plane.

13. A lighting apparatus with a linear light source, comprising:

a light source extending in a longitudinal direction and having terminal parts on both ends of the light source to be connected to a power supply;

a spacer having an internal space that is opened in a front-rear direction and accommodates the light source, wherein mounting parts formed on both ends of the internal space to provide the terminal parts; and a reflective bracket mounted on a rear end of the spacer to cover the internal space, and having fixing parts that match the mounting parts to fix the terminal parts when the reflective bracket is mounted on the spacer, wherein an inner surface of the reflective bracket is configured to reflect light emitted from the light source, wherein the reflective bracket is divided into a first reflective bracket and a second reflective bracket to be disposed on both sides of the spacer, respectively, a first fixing part is formed on the first reflective bracket to match a first mounting part of the spacer and contact a first terminal part of the light source, and a second fixing part is formed on the second reflective bracket to match a second mounting part of the spacer and contact a second terminal part of the light source.

* * * * *